United States Patent [19]

Nieminen

[11] Patent Number: 5,014,396

[45] Date of Patent: May 14, 1991

[54] NON-WOVEN ARTICLE MADE OF A HEAT-RESISTING MATERIAL, METHOD FOR MANUFACTURING THE ARTICLE AND APPARATUS FOR IMPLEMENTING THE METHOD

[75] Inventor: Jorma Nieminen, Kankaanpää, Finland

[73] Assignee: Oy Scanwoven Ab, Kankaanpää, Finland

[21] Appl. No.: 311,501

[22] Filed: Feb. 15, 1989

[30] Foreign Application Priority Data

Feb. 17, 1988 [FI] Finland ..... 880755

[51] Int. Cl.[5] ..... B32B 17/02; B32B 18/00; D01G 21/00; D04H 1/54

[52] U.S. Cl. ..... 19/205; 19/303; 19/304; 428/288; 428/297; 428/360

[58] Field of Search ..... 19/205, 303, 304

[56] References Cited

U.S. PATENT DOCUMENTS

| | | | |
|---|---|---|---|
| 2,468,827 | 5/1949 | Kennedy et al. | 19/304 |
| 3,644,078 | 2/1972 | Tachibana et al. | 19/303 |

FOREIGN PATENT DOCUMENTS

| | | | |
|---|---|---|---|
| 2407058 | 9/1974 | Fed. Rep. of Germany . | |
| 55529 | 4/1979 | Finland . | |
| 76842 | 8/1988 | Finland . | |
| 993902 | 6/1965 | United Kingdom | 19/304 |
| 1287055 | 8/1972 | United Kingdom . | |
| 1426681 | 3/1976 | United Kingdom . | |

*Primary Examiner*—James C. Cannon

*Attorney, Agent, or Firm*—Pollock, Vande Sande & Priddy

[57] ABSTRACT

In a method for manufacturing the fiber-containing article, the discontinuous fibers, intermingled with fibers serving as a binder, are couched into a fiber mat in such a manner that the discontinuous fibers are advanced into contact with an air flow which carries them up to a conveying level where the fibers become randomly directed and the fiber-carrying air flow is passed through this level.

8 Claims, 5 Drawing Sheets

NON-WOVEN ARTICLE MADE OF A HEAT-RESISTING MATERIAL, METHOD FOR MANUFACTURING THE ARTICLE AND APPARATUS FOR IMPLEMENTING THE METHOD

BACKGROUND OF THE INVENTION

The present invention relates to a non-woven article, to a method for the manufacture thereof, and to an apparatus for implementing the method.

Fire-resistant fibres like mineral, glass or ceramic fibres are presently used for manufacturing mineral felt essentially in two ways.

In one method, as early as during the manufacture of a fibre, the fibre is sucked onto a suction wire to form a web. Fabricated this way, the article has a compact texture and high weights per unit area. This method cannot be applied for manufacturing thinner qualities. Another drawback is the formation of granular and bead-like impurities in the articles. It is not possible to admix bonding fibres in the article and final bonding of the article is effected with adhesives which evaporate at low temperatures and, thus, make the use of such article at high temperatures difficult.

Another presently applied technique is to use a mineral, glass or ceramic fibre for manufacturing a web by means of water, much the same way as manufacturing paper. Although, in this method, it is possible to include other fibres as well, long (over 50 mm) synthetic fibres cannot be employed as composite or bonding fibres. Another major drawback is that, when emerging from a machine, the non-woven web is wet and especially thick qualities require high-powered drying, resulting in a less economic production line. Also in this method, the final bonding for providing a firm article can only be effected by suing an organic binder with all its above-mentioned drawbacks.

The weight per unit area or the density of articles produced by these methods is quite considerable, which does not allow for optimum ratio of strength to product weight. When using such article as an insulating material, the density of the article bears also significance.

SUMMARY OF THE INVENTION

An object of the present invention is to provide a non-woven article having qualities superior to the prior art articles.

Another object of the invention is to provide a method for manufacturing a non-woven article from mineral, glass or ceramic fibre in a manner that does not involve large amounts of water while producing an article which has particularly preferable qualities and which can be used as an insulating and building material in many applications that require fireproof fibre. Still another object of the invention is to provide an apparatus for implementing the method for manufacturing the above-described article.

In order to achieve the above objects, an article of the invention is one in which its essential texture is formed by discontinuous fibres which may consist of ceramic fibre, mineral fibre, glass fibre or a composition thereof, the discontinuous fibres being directed in the three-dimensional structure of the article in arbitrary directions relative to each other without forming any distinguished areas, in which the fibres lie in a common plane, as for example, in paper. A web-like article, for example, contains hence a considerable number of fibres that are directed crosswise and angularly relative to the plane of the web. This produces pockets between the fibres to decrease the density of an article. The articles can only be bonded by needlepunching in case there is solely used the heat-resisting discontinuous fibres as mentioned above. However, the article can have admixed therein also a binder which is included in the texture at a temperature lower than discontinuous fibres in the form of melting/softening fibres, the share of discontinuous fibres in the article being in this case at least 70% by weight.

A method of the invention includes bringing the fibres with a properly applied air flow to a plane, through which the air flow is passed, the fibres can be set in a finished article in arbitrary directions giving the produced web a particular loft and elasticity. In a few preferred embodiments of the method, the fibres can be fed from a first conveying level to a second conveying level, for example, by means of an air flow from the top of a first lower conveying level to the bottom surface of a second conveying level and the finished web is retained there by virtue of an air flow passed through the conveying level. If the starting material comprises mineral fibres that are not pretreated and contain beads and possibly sand, these can be be pretreated for producing a highly clean web comprising only discontinuous fibres and possibly composite fibres.

The present invention also relates to an apparatus for carrying out the method of the invention.

A web manufactured by the present invention method can be subjected to an after-treatment for producing a finished article. Thus, the fibres can be bonded by needlepunching only or, if there are bonding fibres involved, it is possible to use both needlepunching and thermal binding. The finished article can thus be in the shape of a mineral wool type of fluffy or lofty insulating material but the web can also be used for manufacturing boards, beams, and the like, used as building elements by compressing superimposed non-woven webs into a more compact texture during thermal binding. In the latter case, the density of such article will be lower than that of the corresponding articles manufactured by traditional methods.

The invention will now be described in more detail with reference made to the accompanying drawings, in which

BRIEF DESCRIPTION OF THE PREFERRED EMBODIMENT(S)

Figure 1:
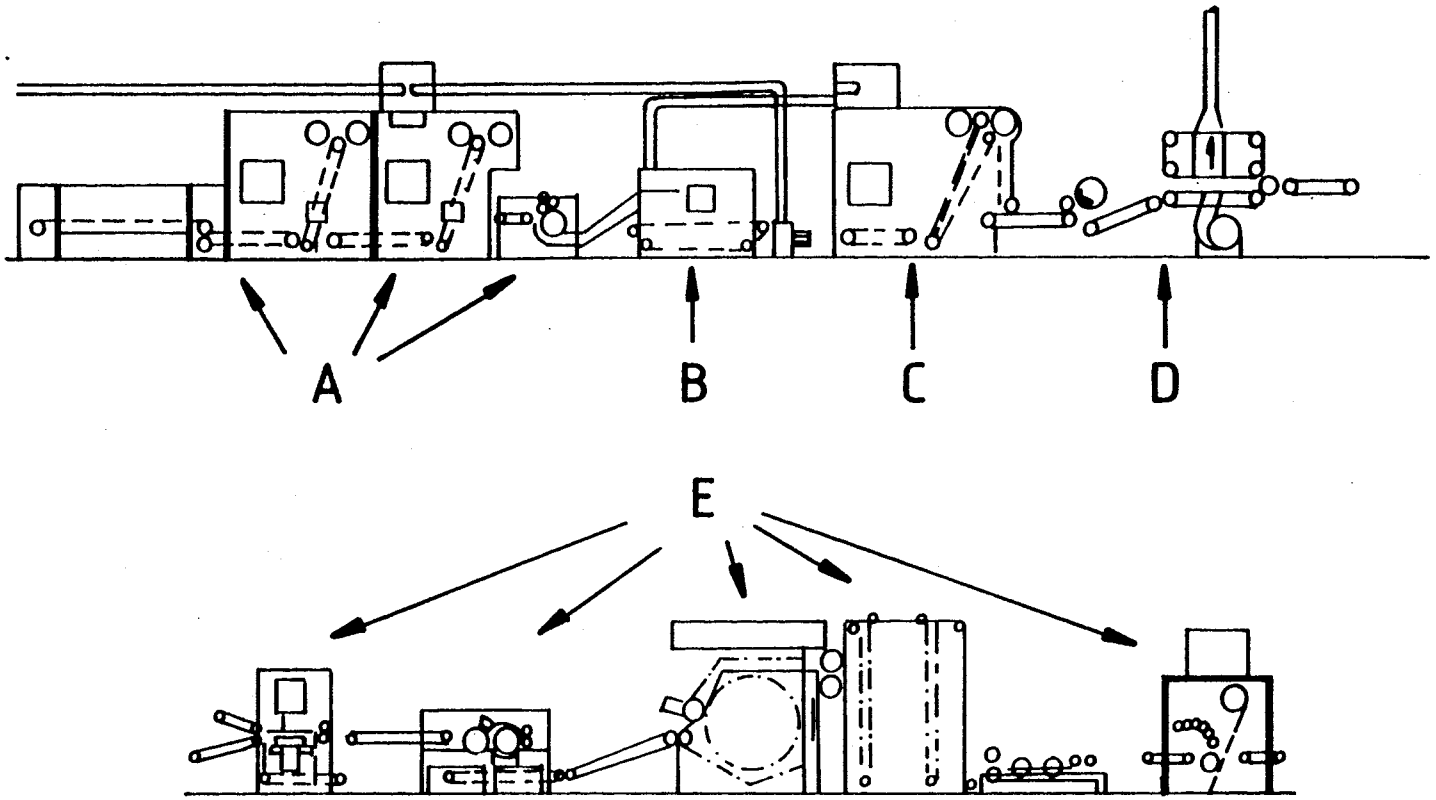
FIG. 1 shows diagrammatically an entire fibre production line applying a method and an apparatus of the present invention and FIGS. 2–5 are more detailed views of different sections of the line shown in FIG. 1.

Reference character A in FIG. 1 indicates a pretreatment unit, character B indicates a separating unit, character C indicates a supply unit and character D indicates a web-forming unit, with character E indicating known after-treatment equipment.

Figure 2:
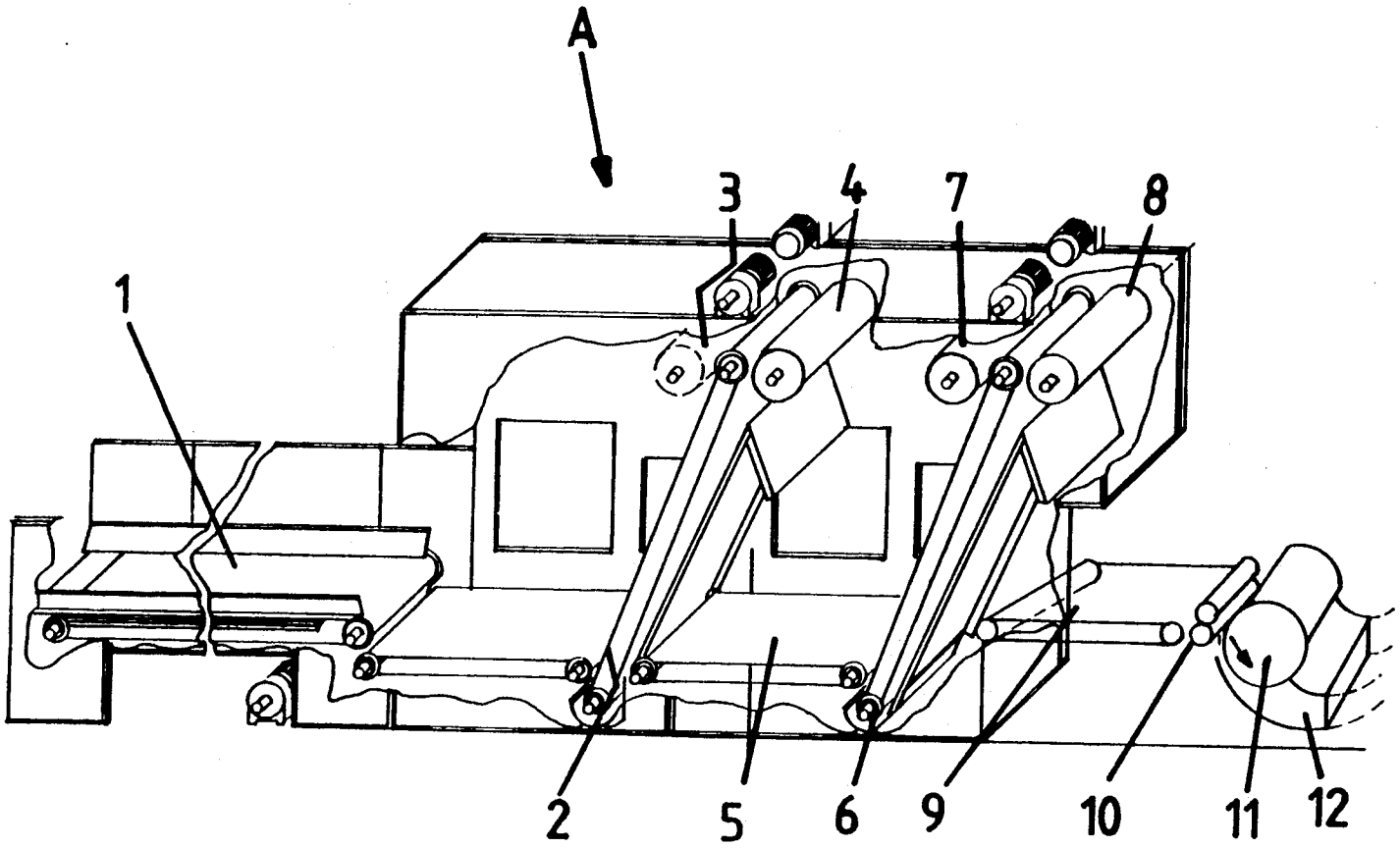

FIG. 2 shows a pretreatment assembly A at the forward end of a production line in a perspective view and partially cut away. Bundles of fibre are forwarded onto a conveyor 1, automatically controlled by photocells. From conveyor 1 the fibre travels to an elevator bucket 2 whose studs lift the fibre up along a fast-rotating smoothing roll 3. The smoothing roll 3 throws the unopened bundles of fibre back down until they are opened and the fibres are able to pass between smoothing roll and elevator bucket 2. Thereafter, the fibres hit a fast-rotating release roll 4 which flings the fibres down onto a conveyor belt 5. This is followed by a second set of the same operations, that is conveyor belt 5 is followed by an elevator bucket 6, a smoothing roll 7 and a release roll 8 for flinging the completely opened fibres down onto a conveyor belt 9. This conveyor carries the fibres between feeding rolls 10 for advancing the fibres towards the surface of a fast-rotating studded roll 11. The studded roll is formed by coating a roll with a studded strip and on the roll surface the studs are at a very dense pitch. The roll has a surface speed of about 800–1100 m/min and a mechanical impact provided by the studs produces such an effect that impurities, such as beads, carried by the fibres are removed from the rest of the fibre and, a suitable fibre material can be separated from raw material.

The raw material to be used comprises fire-resisting discontinuous fibre, glass fibre, ceramic fibre or any mixture thereof, the average length of fibres being about 4 mm but there may be included fibres having a length of up to 20 mm. In this context, the term "discontinuous fibres" refers to the opposite of filament fibre, that is to precisely dimensioned fibres which are produced in precise dimensions during the actual fibre production (mineral fibres and ceramic fibres) or which are cut to a precise dimension from a filament (glass fibre). In order to produce a desired article, length of the fibres must be in any case less than 60 mm. As fibres are being fed in a pretreatment assembly, it is possible to admix therein at the same time some fibre, such as some synthetic fibre, which serves as a binder during a thermal bonding process effected later and whose length can be up to 120 mm, whereby such fibre can be any fibre, according to a particular application, such as PET (polyester) or glass. The binder forming fibre must have a lower melting point than the fibre forming the actual product texture. Glass fibre can be used as a binder provided that the rest of the fibre comprises ceramic fibre or mineral fibre.

Figure 3:
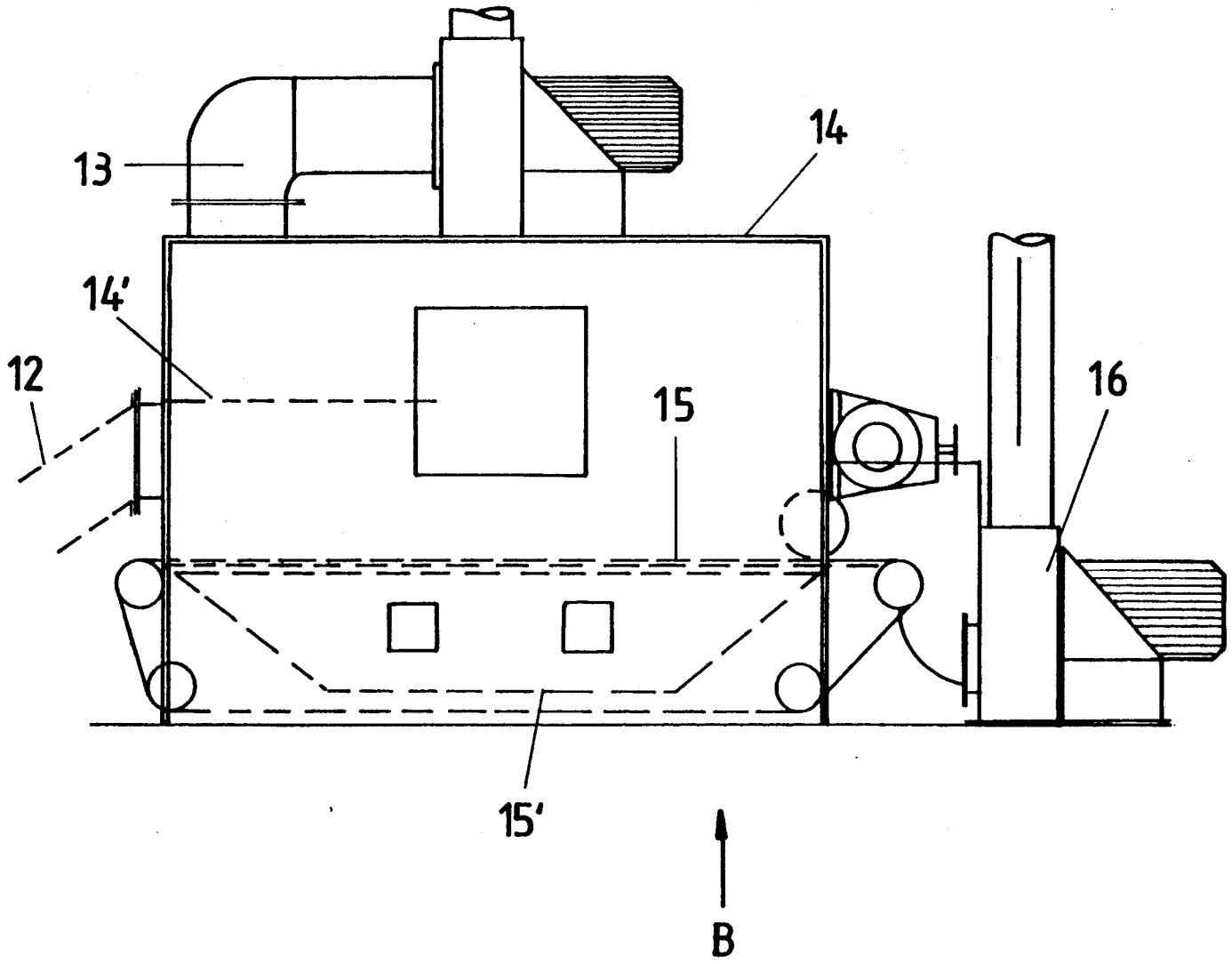

The fibres, impurities removed therefrom and possibly other matter drifting along are carried from pretreatment assembly A to a separation assembly B, shown in FIG. 3 in a side view. In FIG. 2 there is shown the end of an intake duct 12 which is in communication with the surface of studded roll 11, the other end of the intake duct being in communication with separation assembly B. The separation assembly comprises a closed box 14 which receives an intake duct 12 coming from studded roll 11 and from which issues an intake duct 13 connected with a source of suction, such as a conventional fan. By means of suction supplied through duct 13, the fibres are sucked through the box into duct 13 such that the fibres, being lighter in weight, rise up into the duct 13. For this purpose, the inlet of intake duct 12 is located lower than the outlet of intake duct 13 and, furthermore, between these ports is mounted a horizontal flow baffle 14' which blocks a linear flow in the box between these ports, creating a bend in the flow path and this enhances the separation of heavier matter from the fibres. The beads and other impurities, such as sand, removed from the fibre fall through the holes of a screen-like conveyor belt 15 fitted below the horizontal baffle 14 into a receptacle chute 15' from which they can be removed from time to time. The heavier matter, such as unopened bundles of fibre, remains however on top of conveyor belt 15 which carries it outside the box 12 for passing it to a fan 16 which blows it along a line 17 shown in FIG. 1, back to pretreatment assembly A.

Figure 4:
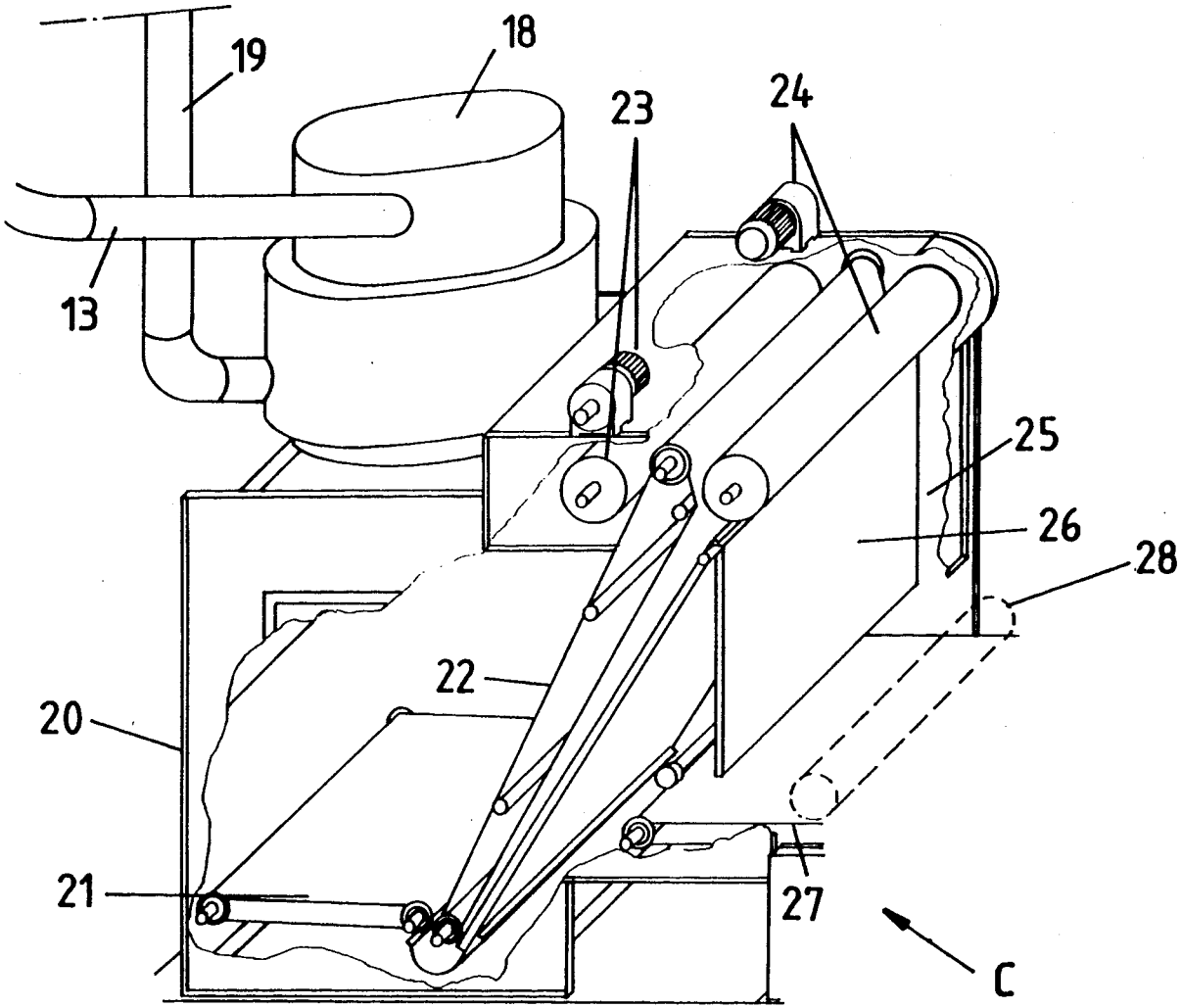

FIG. 4 illustrates a supply or feeding assembly C located downstream of separation assembly B. Here, the other end of flow duct 13 coming from separation assembly B is passed through a cyclone 18 for separating the fibres from finer solid matter which is carried away through a vacuum pipe 19. The refined fibres fall into a box 20 below the cyclone. The box contains a horizontal conveyor belt 21 which receives the falling fibres and pushes them onto a studded belt 22 which carries the fibres obliquely upwards and at the top section of this belt loop the fibres travel between smoothing roll 23 and belt 22. The smoothing roll 23 distributes the fibres uniformly in lateral direction, whereafter a release roll 24 drops the fibres vertically into a volume feeding chute 25 whose movable back wall 26 presses the fibre web or mat to uniform density. The chute 25 opens at its bottom above a conveyor belt 27 and the fibre mat travels upon conveyor 27 forward from below the chute 25 between a roll 28, shown by dash-and-dot lines, and a conveyor, the latter compressing the web uniformly onto conveyor 27 which carries it forward to the following unit. At this point, it is also possible to adjust a desired weight per unit area for the finished non-woven web by adjusting the speed of conveyor 27, the fibre volume in the feeding chute being constant.

Figure 5:
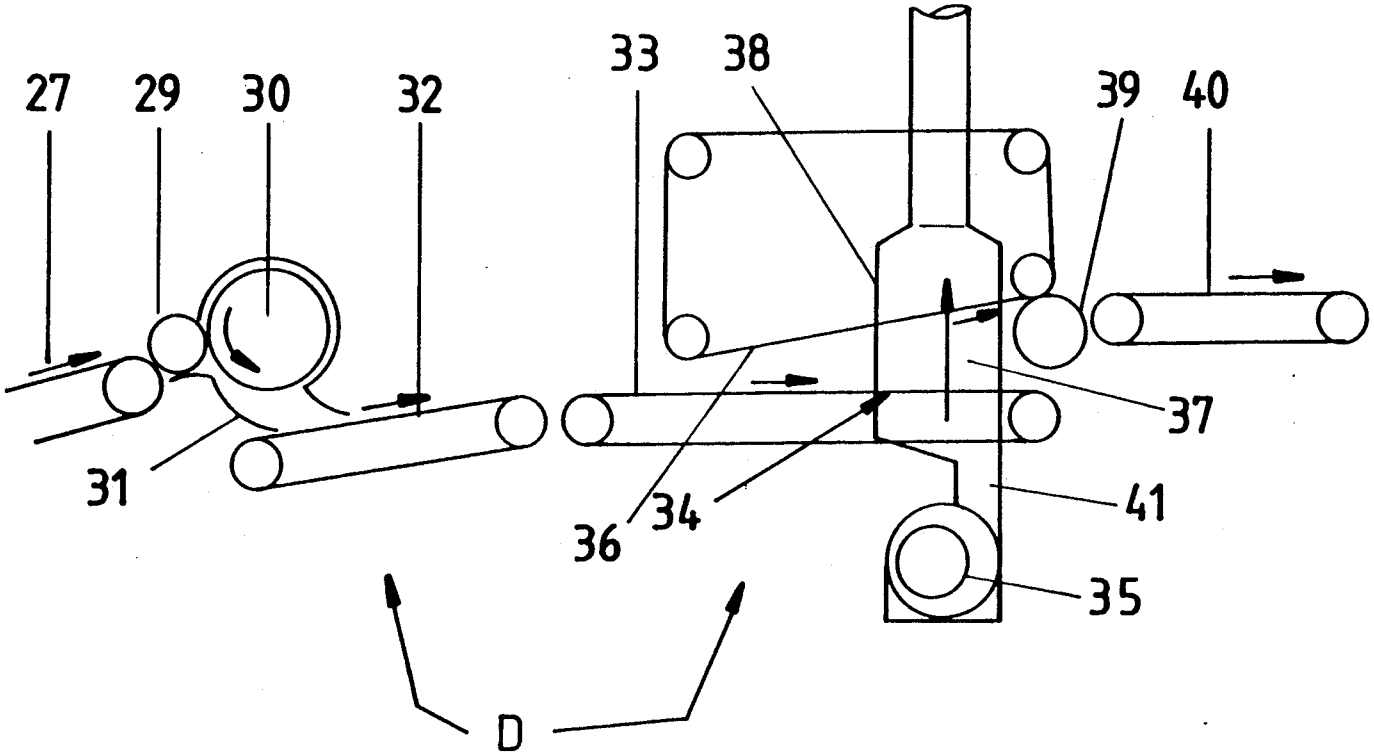

FIG. 5 is a side view of a web-forming unit D. The conveyor 27 carries the fibre from below a slow-rotating feeder roll 29 towards the surface of a fast-rotating studded roll 30. The studded roll is coated with a studded strips and the studs are positioned at a very dense pitch and their length is about 2 mm. The surface speed of the studded roll is about 2000–2500 m/min. To the surface of the studded roll, at the point where the fibres come in contact with it, a powerful air jet is blown which is passed through an air duct 31 which is in communication with the space below studded roll 30 towards the surface of a conveyor wire 32. The fibres are thus carried along with the air flow and remain on top of conveyor wire 32 while the air flow is sucked through the wire. Thus, the fibres build a relatively uniform mat or web on wire 32 which carries them forward onto a foraminous conveyor belt 33. At this point, the mat has some corrugation in it and still includes some areas wherein the fibres extend in parallel direction, which results from turbulence of the air flow. Conveyor belt 33 carries the fibre mat forward to a point 34, whereat a powerful air flow is supplied below conveyor belt 33 by means of a fan 35 along a duct 41 opening below the belt 33, the air flow penetrating through belt 33 by virtue of its foramens and blowing the fibres at this point to an air-permeable conveyor wire 36 above. The top of surface of conveyor belt 33 carrying the fibre mat in the beginning and the bottom surface of conveyor wire 36 intended for the final build-up of a fibre mat are at this point located opposite to each other and provide therebetween an open space 37 wherein the air flow passed through the conveyor belt 33 picks up the fibres from the top surface of belt 33 to the bottom surface of belt 36. Above the conveyor wire 36, in other words on the backing side of a fibre mat in view of its build-up surface, there is a suction duct 38 into which the air flow is passed from space 37 through wire 36. All of the air flow blown through conveyor belt 33 is passed through wire 36 and, for this purpose, the space 37 is sealed as tightly as possible both at the side edges of conveyor belt 33 and those of conveyor wire 36 and also upstream of the point of blowing and downstream of the point of blowing, by only leaving the gaps for allowing the fibre mat into space 37 above belt 33 and from space 37 to the bottom surface of wire 36.

The conveyor belt 33 comprises a wire structure, for example, a conventional nylon wire having foramina that are circular and relatively large having about 1,5 mm in diameter. The upper section in a conveyor wire may consist of a normal wire but a particularly preferred and uniform setting of fibres is obtained by using a so-called honeycomb-type of wire.

The air flow in space 37 has a speed of about 10–30 m/s which is sufficient to provide intermingling of the fibres and to set them in random directions on settling on conveyor wire 36. Conveyor belt 33 and conveyor wire 36 are carried in the same directions and a relatively even mat that lies first on lower conveyor belt 33 leads to the formation of a product having a uniform weight per unit area also on upper conveyor wire 36.

Following the space 37, a fibre mat on conveyor wire 36 is carried between the wire and a nip roll 39 onto a conveyor belt 40 for carrying the finished article forward.

Following the above-described formation of a web, the fibre mat is advanced to after-treatment equipment, used for final bonding of the fibres and designated in FIG. 1 with reference E. In case the fibre mat consists exclusively of mineral fibres or the like, it will only be bound by needlepunching in a conventional needlepunching machine in which the binding is effected mechanically by punching with needles. If the structure includes binder-forming bonding fibres as mentioned above, such as glass or polyester fibres, it is possible to employ also thermal bonding in addition to needlepunching. Thermal bonding can also be accompanied by other additional operations, such as compressing fibre mats into sheets, beams or similar rigid structures.

The above-described method can be applied for manufacturing from mineral glass or ceramic fibres or their mixtures some mat-shaped or sheet-like articles, whose weight per unit area is within the range of 60–3000 $g/m^2$. The best way of comparing articles of the invention with traditional heat-resisting non-woven products is to compare their desities to each other. The density of both mat-like articles and those compressed into sheets and beams is about 5 times less than that of the products manufactured from the same materials with prior known methods. However, the strength qualities are in the same order. By adjusting the process conditions (air flow rate, compression in after-treatment) this ratio can be made up to 10-fold.

When bonding fibre is used, its share of the product is always less than 30%. It should be noted that glass can be used either as a structure-forming fibre, the binder comprising a synthetic fibre, such as PET, or glass can be included in the articles as a binder, the main structure consisting of mineral fibres and ceramic fibres which melt at higher temperatures than glass.

The articles can be used in all fire-resisting materials, such as interior carpets and shapes in vehicle industry, underlying carpets and sound-proof surfaces in shipbuilding industry, roofing felt, PVC-coating bases as well as building boards. One important application of these articles includes high-temperature insulations, for example, products for replacing health-hazardous asbestos.

The invention is by no means limited to the embodiments described in the specification and illustrated in the drawings but can be modified within the scope of an inventive idea set forth in the annexed claims. For example, it is conceivable to employ fibre material prerefined already at an earlier stage, whereby such material can be directly fed into feeder assembly C. In addition, a web-forming unit D of the invention has many alternative designs for producing a blow to the mat-forming level by means of air flow. In the web-forming unit D shown in the drawings, for example, the planes or levels need not be necessarily located as a first conveying plane below a second conveying plane but what is required is that the surfaces of these conveying planes be directed towards each other for providing therebetween a space, wherein the above-described blowing of the fibres can be effected. However, in view of the most economic use of space and practical aspects, it is preferable that the planes be aligned with each other in vertical direction and preferably as described above, i.e. the first conveying plane below the second conveying plane.

I claim:

1. A method for manufacturing a discontinuous fiber-containing article from ceramic fibers, glass fibers, mineral fibres or a mixture thereof in which said fibers are couched into a mat of randomly oriented fibers having a uniform weight per unit area, said method comprising the steps of:

forming fibres into a substantially uniform fiber mat at a first conveying level which carries the fiber mat forward;

advancing the fiber mat into an air flow passed through the first conveying level to carry said fiber mat to a second conveying level, which at the air flow path is positioned opposite to the first level, and carries the fibres forward, so that the fibres are removed from the first conveying level and are randomly directed and settle as a fiber mat on the second conveying level, said fibre-carrying air flow being passed through the second conveying level.

2. A method according to claim 1, wherein the first conveying level is located at the air flow path below the second conveying level, whereby the conveying surface of the first conveying level faces upwards and the conveying surface of the second conveying level faces downwards, and wherein said fibres are being picked up by means of an upward-directed air flow from the top of the first conveying level to the bottom surface of the second conveying level.

3. A method according to claim 1, wherein said substantially uniform fiber mat on the first conveying level is formed by advancing the fibre mat by means of feeder device towards the surface of a fast-rotating studded roll, from which the fibres are passed by means of an air flow to the first conveying level and the air flow is passed through the first conveying level.

4. A method according to claim 3, wherein the first conveying level comprises a first section including an air-permeable conveyor wire onto which the fibres are advanced by means of an air flow from the studded roll and a second section downstream of the first section including a foraminous conveyor, through which the air flow is blown, for carrying the fibres to the second conveying level.

5. A method according to claim 1, wherein the starting material for said fiber mat comprises non pre-treated mineral fibres containing beads and other impurities, and wherein prior to forming said mat on said first conveying level, the bundles of fibres are advanced towards the surface of a fast-rotating studded roll, whereat the beads contained in the fibres are removed by means of a mechanical impact caused by the studs.

6. A method according to claim 4, wherein the starting fiber material for said fiber mat comprises non pre-treated mineral fibres containing beads and other impurities, and wherein prior to forming said mat on said first conveying level, the bundles of fibres are advanced towards the surface of a fast-rotating studded roll, whereat the beads contained in the fibres are removed by means of a mechanical impact caused by the studs.

7. A method according to claim 5, wherein after removal of the beads, the fibres are separated from the beads and other impurities by entrapping the fibres in an air flow.

8. A method according to claim 1, wherein the fiber mat includes fibers which function as binders when said fiber mat is subjected to fiber-binding conditions.

* * * * *